US006094950A

United States Patent [19]

Maynard et al.

[11] Patent Number: 6,094,950

[45] Date of Patent: Aug. 1, 2000

[54] SWING DOOR LOCK FOR REFRIGERATED CABINET

[75] Inventors: James Maynard, Alpharetta, Ga.; Neil Lionel Alexander, Toronto; Milan Savic, Willowdale, both of Canada

[73] Assignee: Habco Beverage Systems Inc., North York, Canada

[21] Appl. No.: 09/127,816

[22] Filed: Aug. 3, 1998

[30] Foreign Application Priority Data

Aug. 6, 1997 [CA] Canada ..... 2212419

[51] Int. Cl.[7] ..... E05B 65/44

[52] U.S. Cl. ..... 70/81; 70/83; 70/86; 70/360; 70/370

[58] Field of Search ..... 70/139, 58, 360, 70/78, 79, 80, 81, 83, 84, 85, 86, 370, 451, 102, 104, 105, 131, 136; 292/DIG. 71, DIG. 65, 288, 289, 290

[56] References Cited

U.S. PATENT DOCUMENTS

| | | | |
|---|---|---|---|
| 2,878,663 | 3/1959 | Smith | 70/370 |
| 3,136,017 | 6/1964 | Preziosi | 24/221 |
| 3,589,152 | 6/1971 | Glass | 70/81 |
| 3,593,550 | 7/1971 | Berkowitz | 70/207 |
| 4,248,067 | 2/1981 | Sears | 70/58 |
| 4,345,448 | 8/1982 | Solomon | 70/95 |
| 4,570,467 | 2/1986 | Greco | 70/99 |
| 4,724,689 | 2/1988 | Anchia | 70/58 |
| 5,040,393 | 8/1991 | Rossebo | 70/370 |
| 5,094,489 | 3/1992 | Jones | 292/340 |
| 5,381,685 | 1/1995 | Carl et al. | 70/78 |
| 5,657,652 | 8/1997 | Martin | 70/85 |
| 5,678,437 | 10/1997 | Walla | 70/370 |

*Primary Examiner*—B. Dayoan
*Assistant Examiner*—Clifford B Vaterlaus
*Attorney, Agent, or Firm*—Ingrid E. Schmidt

[57] ABSTRACT

The invention provides a lock assembly suitable for securing a swing door hinged to a refrigerated cabinet and is intended to dissuade pilfering. The lock assembly includes a strike plate having a mounting plate for mounting to the cabinet, and a locking plate spaced from the mounting plate. The lock assembly further includes a door bracket having an outer door plate to be located on an outer surface of the swing door, and a locking member mounted to the door bracket. The locking member has a locking shaft connected to the locking member for rotation with the locking member. The locking member is locatable between the mounting plate and locking plate of the strike plate and against the locking plate to lock the swing door to the cabinet in a first angular position of the locking shaft, and released from the locking plate to unlock the swing door in a second angular position of the locking shaft.

4 Claims, 6 Drawing Sheets

SWING DOOR LOCK FOR REFRIGERATED CABINET

FIELD OF THE INVENTION

This invention relates to a lock suitable for securing a swing door to a refrigerated cabinet and is intended to dissuade pilfering.

BACKGROUND OF THE INVENTION

Refrigerated cabinets are generally provided for the convenience of customers who require ready access to cold beverages for immediate consumption. Outside of regular business hours, it is sometimes desirable to restrict access to such cabinets in order to dissuade pilfering and yet it is problematic to find suitable locking means which are not awkward to use, which may readily be installed in the field, and which are aesthetically pleasing.

An object of this invention is to provide a lock mechanism which may readily be installed on a refrigerated cabinet without any structural modifications to the door and cabinet assembly and which is intended to dissuade pilfering.

SUMMARY OF THE INVENTION

In accordance with the invention, there is provided a lock assembly for a swing door hinged to a cabinet, the lock assembly comprising a strike plate having a mounting plate adapted to be mounted to the cabinet, and a locking plate spaced from the mounting plate; a door bracket having an outer door plate adapted to locate on an outer surface of the swing door, and a locking member mounted to the door bracket, the locking member having a locking shaft coupled to the locking member for rotation therewith, the locking member being adapted to be disposed between the mounting plate and locking plate of the strike plate and to locate against the locking plate to lock the swing door to the cabinet in a first angular position of the locking shaft, and the locking member being adapted to be released from the locking plate to unlock the swing door in a second angular position of the locking shaft.

BRIEF DESCRIPTION OF THE DRAWINGS

A preferred embodiment of the invention is now described below with reference to the accompanying drawings in which.

DESCRIPTION OF PREFERRED EMBODIMENT

As indicated above, the invention relates to a door lock which is used to secure a swing door which is hinged to a cabinet and finds particular application to refrigerated cabinets which are used for self-serve access to cold beverages or other refrigerated items. Only portions of a refrigerated cabinet are shown in the accompanying drawings as their basic structure is already well-known to those skilled in the art.

Figure 1:
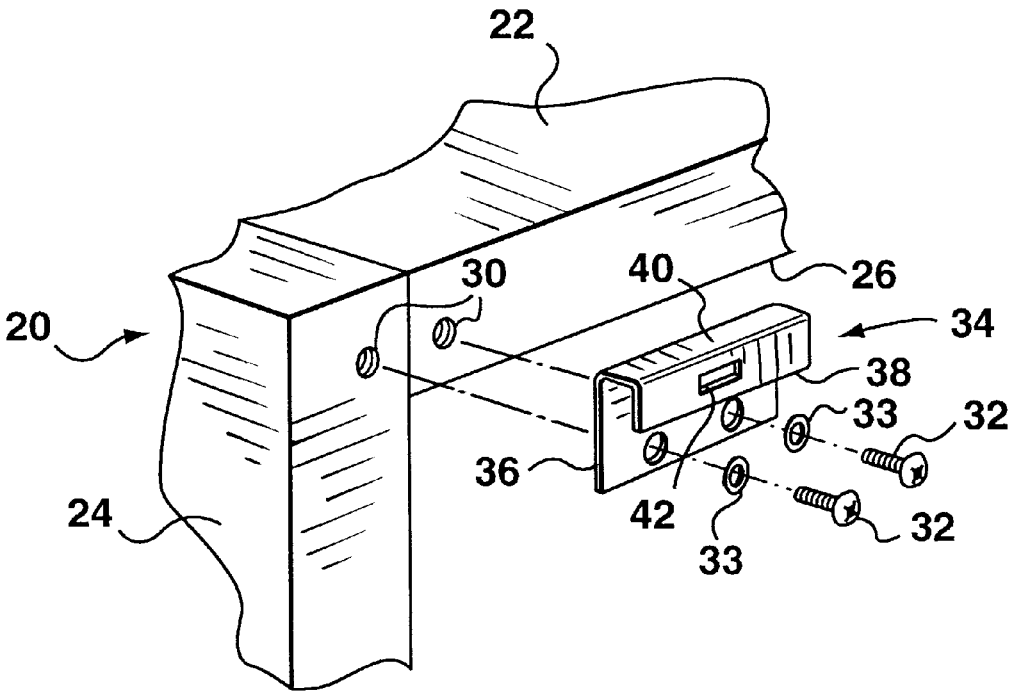
FIG. 1 is an assembly drawing showing a strike plate for mounting to a cabinet.

In FIG. 1, there is illustrated the top left corner of a cabinet generally indicated by the numeral 20 and having an upper wall 22 disposed horizontally adjacent to a vertically extending side wall 24. Together, the upper wall and side wall define a front opening 26 for accessing the cabinet interior. A door 28 (FIG. 3) is hinged to the right of the cabinet opening 26 (as drawn), in a manner which is well known in the art and which is not shown in the drawings.

It will be appreciated that the swing door 28 may alternatively be hung on the left side of the cabinet which conveniently is pre-drilled with suitable threaded openings 30 adapted to receive mounting bolts 32.

Conveniently, a strike plate 34 forming part of the lock assembly of the invention is mounted to the cabinet 20 using the pre-drilled threaded openings 30 and mounting bolts 32, thereby greatly facilitating field installation of the lock assembly. The strike plate 34 comprises a sheet metal plate bent into a U-shaped configuration and defining a mounting plate 36 which is apertured to receive the mounting bolts 32 and, in use, is disposed adjacent to the cabinet 20. A locking plate 38 is forwardly spaced from the mounting plate 36 by a transversely-extending connecting web 40 and is somewhat shorter in height than the mounting plate so as to permit ready access to the mounting bolts 32 and associated washers 33. A rectangular opening 42 is formed in the locking plate 38 and is adapted to receive a locking member 90 as will be described in more detail further below.

Figure 2:
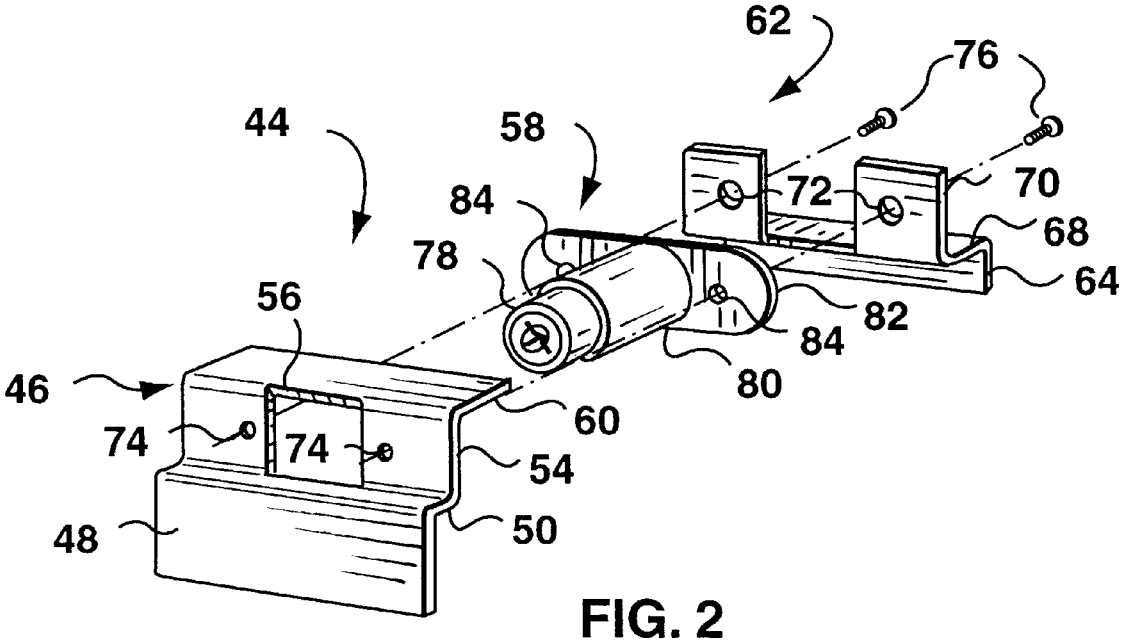
FIG. 2 is an assembly drawing showing a barrel lock in association with a door bracket in accordance with the invention.
Figure 3:
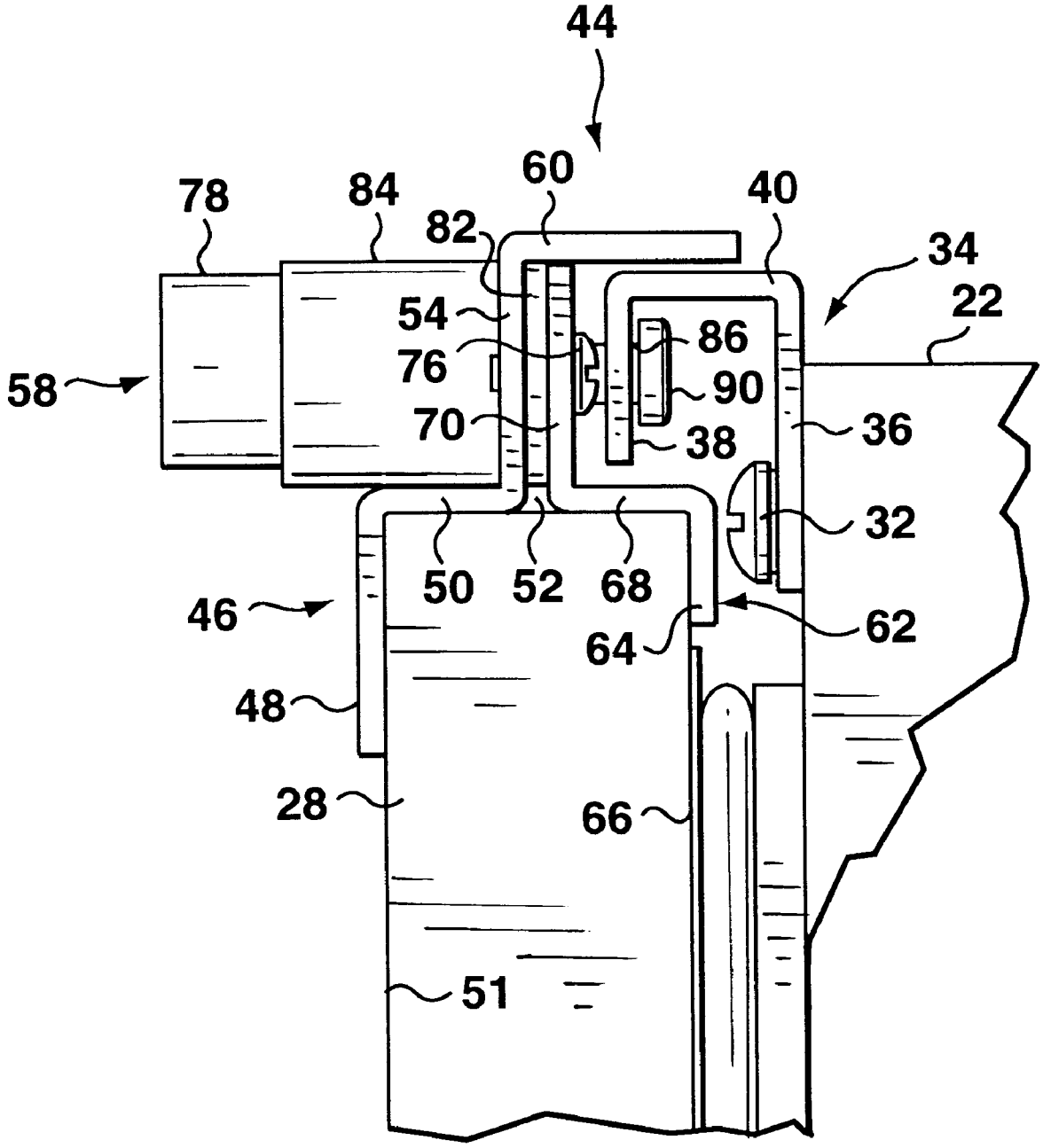
FIG. 3 is a side elevation view of the door lock in accordance with the invention associated with a swing door and cabinet assembly.
Figure 4:
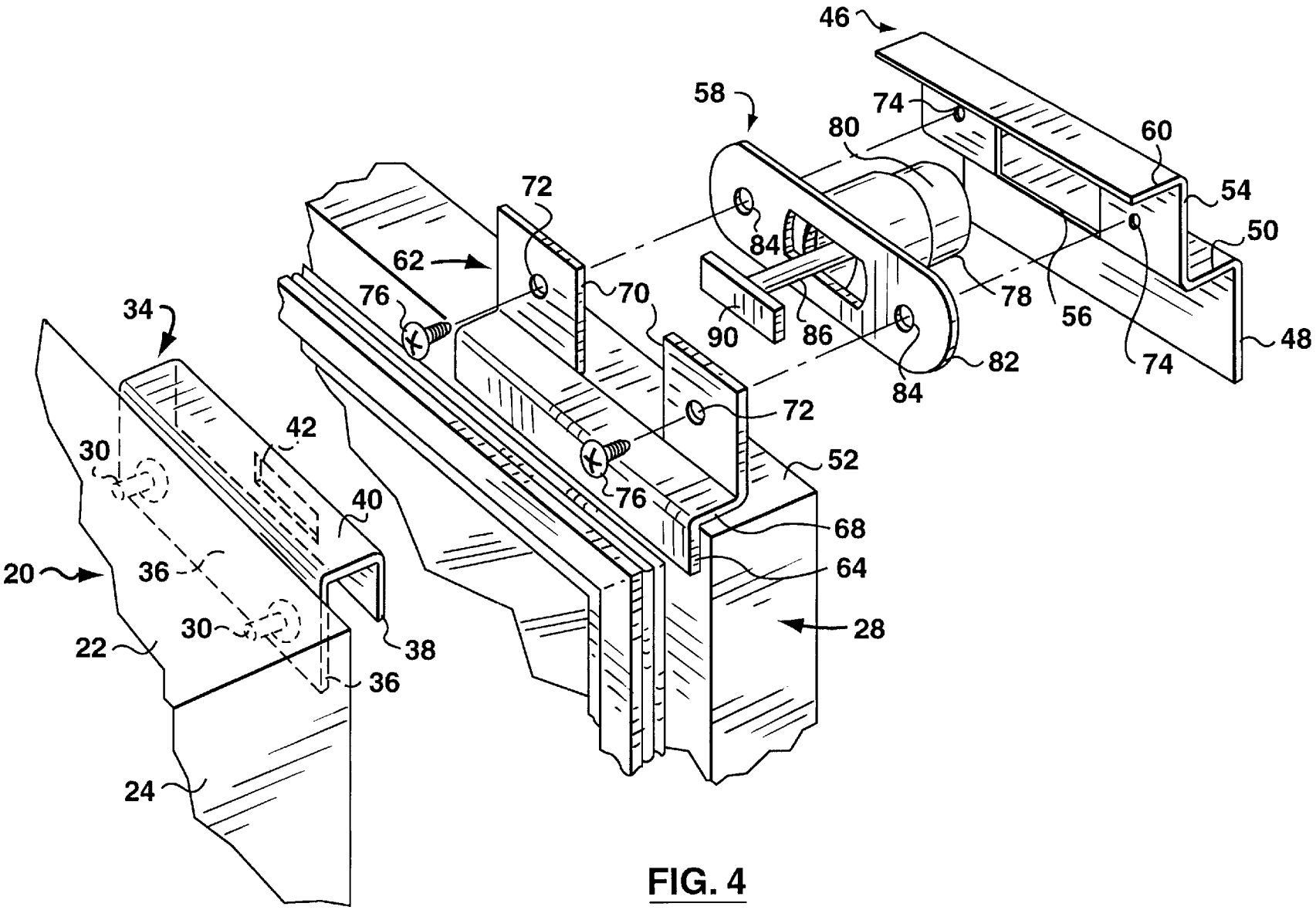
FIG. 4 similar view to FIG. 2 from the opposite side and showing the door lock assembly in association with a swing door and cabinet assembly.

A door bracket in the form of a "saddle" cooperates with a free edge of the swing door 28 and is generally indicated in FIGS. 2 to 4 by reference numeral 44. The door bracket comprises an outer door plate 46 having a first vertically extending portion 48 (as drawn) which, in use, locates against the outer surface 51 of the swing door 28, a first horizontally extending portion 50 which is orthogonal to the first vertically extending portion and locates against the top free edge 52 of the swing door, a second vertically extending lock receiving portion 54 having a square opening 56 (FIG. 2) formed therein and adapted to receive a barrel lock 58. A second horizontal portion 60 extends further inwardly toward the cabinet 20 and is spaced by the second vertically-extending portion 54 so as to overhang the connecting web 40 of the strike plate 34.

The door bracket further comprises an inner door plate 62 which, likewise, has a first vertically extending portion 64 (as drawn) which, in use, is adapted to locate against an inner surface 66 of the swing door 28. The inner door plate 62 also has a first horizontal portion 68 which is adapted to locate against the top free edge 52 of the door and a second vertically extending portion 70 comprising spaced apart flanges and dimensioned to be accommodated under the second horizontal portion 60 of the outer door plate 46.

The outer door plate 46 and inner door plate 62 each have transversely spaced apertures 74, 72 respectively in their second vertically extending portions 54, 70 which receive a pair of fasteners 76.

The barrel lock 58 comprises a spring-biased key-operated barrel plunger 78 which is rotatably received in a barrel housing 80 mounted to a base plate 82 which defines a pair of outwardly extending flanges on opposite sides of the barrel lock and each having a threaded aperture 84 adapted to cooperate with the fasteners 76. In the embodiment illustrated, the barrel lock 58 is permanently mounted to the saddle bracket such that the barrel housing 80 is received in the square opening 56 of the outer door plate 46 and the base plate 82 is sandwiched between the inner and outer door plates 62, 46, as can be seen most clearly in FIG. 3.

The internal construction of the barrel lock is not shown in the drawings but will be apparent to those skilled in the art. A locking shaft 86 (FIG. 4) is coupled to the barrel plunger 78 for rotation with the barrel upon operation of a key 88 (not shown). The locking shaft 86 has a locking member in the form of a T-bolt 90 which is dimensioned to be received between the flanges of the second vertical portion 70 and through the rectangular opening 42 in the locking plate 38 of the strike plate 34. It will be understood that the T-bolt 90 can slide in and out of the opening 42 in an unlocked angular orientation of the barrel plunger 78 and that the T-bolt 90 is adapted to locate against the locking plate 38 in other angular positions of the barrel plunger and the associated locking shaft 86.

In use, the door bracket and barrel lock assembly can be removed from the cabinet 20 by releasing the T-bolt 90 from the strike plate 34. In this way, there are no unsightly devices which are exposed to view during normal operating hours, the only permanently attached portion of the lock assembly being the strike plate 34. Also, since the strike plate 34 is mounted using the existing pre-drilled holes for alternative location of the swing door 28 on the cabinet 20, there is no permanent deformation of the cabinet and the door is left unmarred.

It will be appreciated that the lock assembly is intended to be used as a deterrent only in order to discourage pilfering. To some extent, the second horizontal portion 60 of the outer door plate 46 obstructs access to the locking shaft 86 in order to minimize tampering with the device. However, the lock assembly is not intended to be used to protect any valuables in the associated cabinet.

Figure 5:
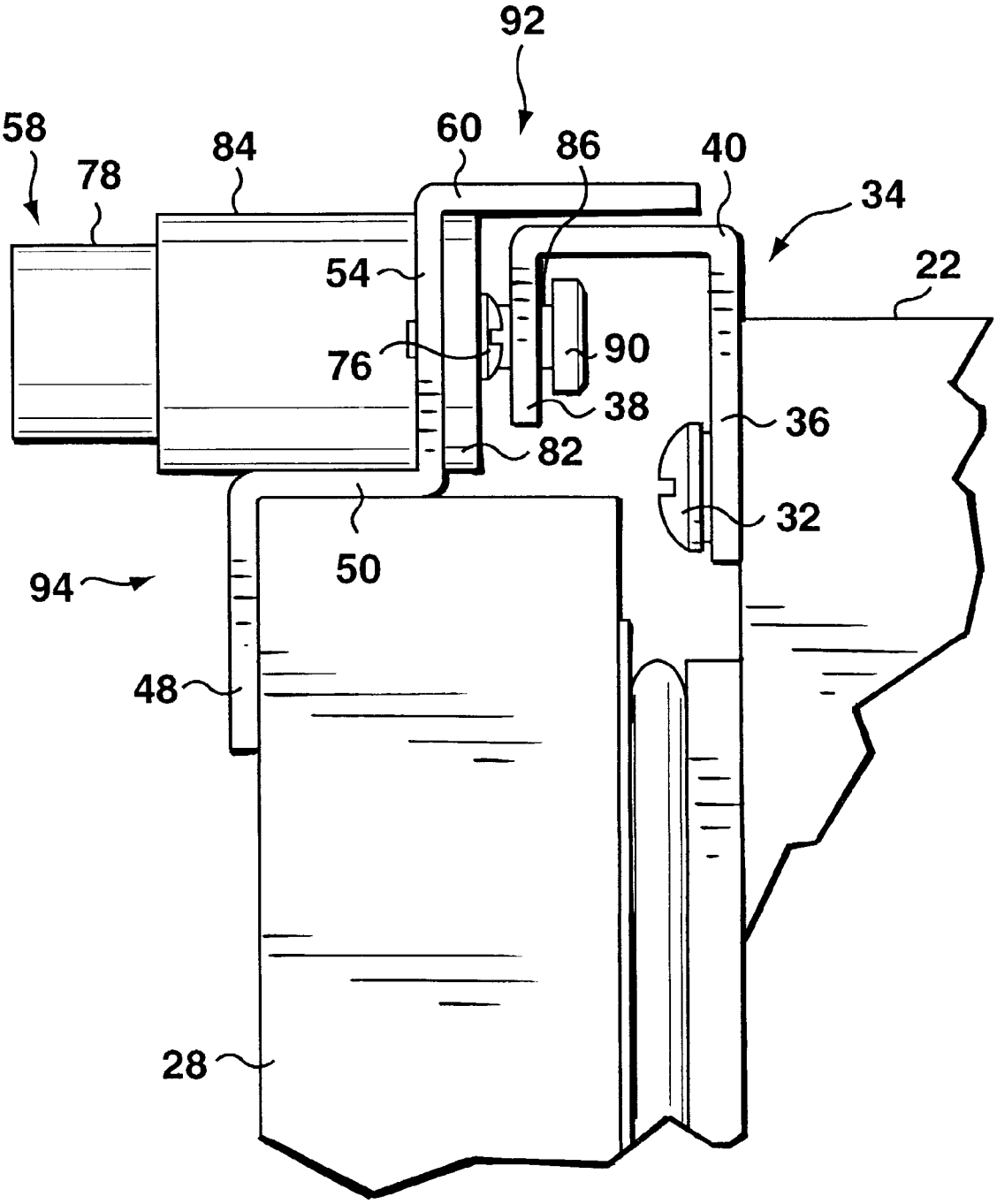
FIG. 5 is a similar view to FIG. 3 showing a first alternative embodiment of the invention.

In a first alternative embodiment of the invention, the lock assembly indicated by reference numeral 92 in FIG. 5 comprises a strike plate 34 which is similar to that in FIGS. 1 to 4 and has like parts identified by like numerals. However, the door bracket 94 does not include an inner door plate 62. The remaining components of the door bracket 94 are identified by like numerals to those used in FIGS. 1 to 4. It will be seen that the barrel lock 58 is therefore fixed directly to the door bracket 94 and is stabilized when the T-bolt 90 engages the locking plate 38.

Figure 6:
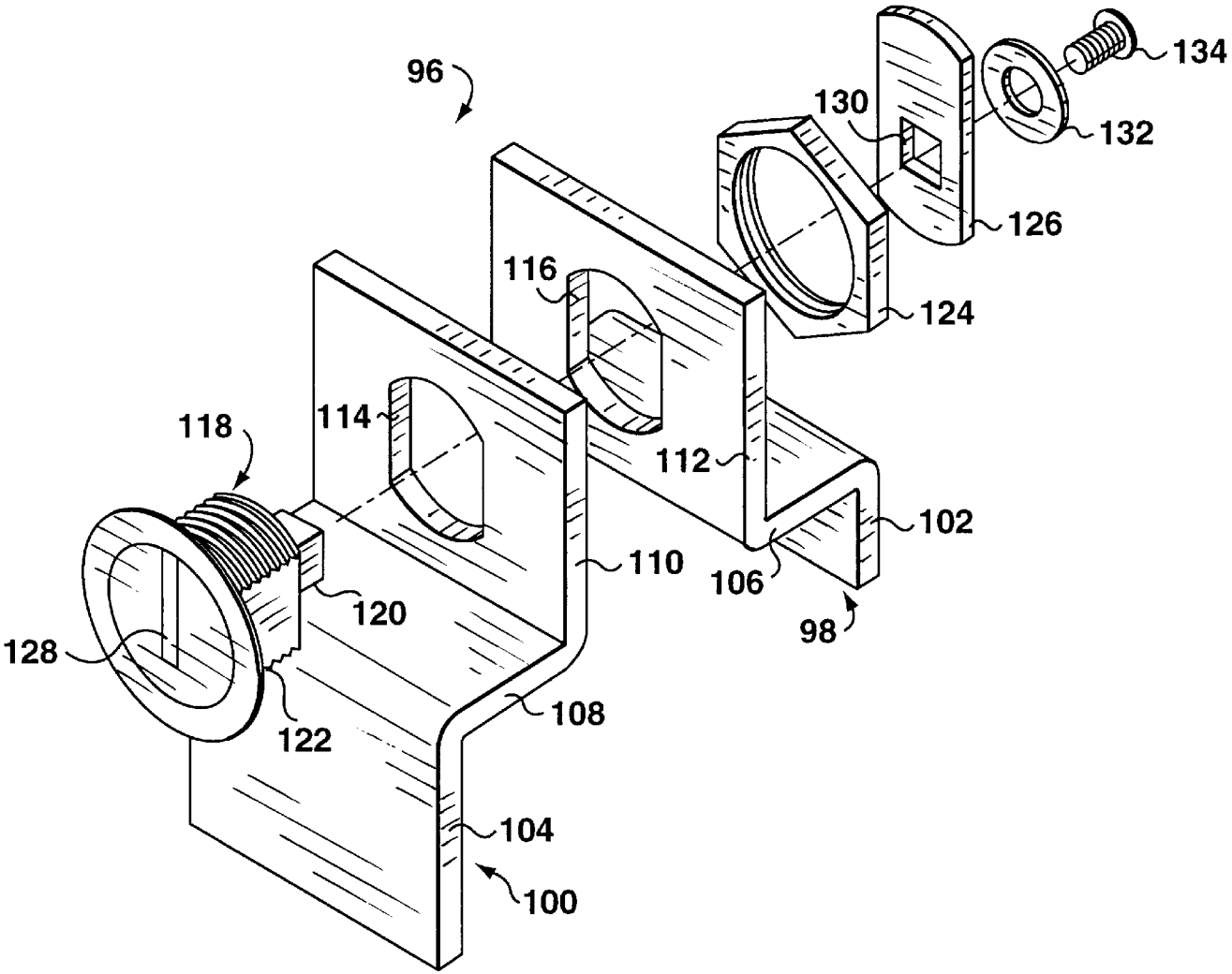
FIG. 6 is a similar view to FIG. 2 showing a second alternative embodiment of the invention.
Figure 7:
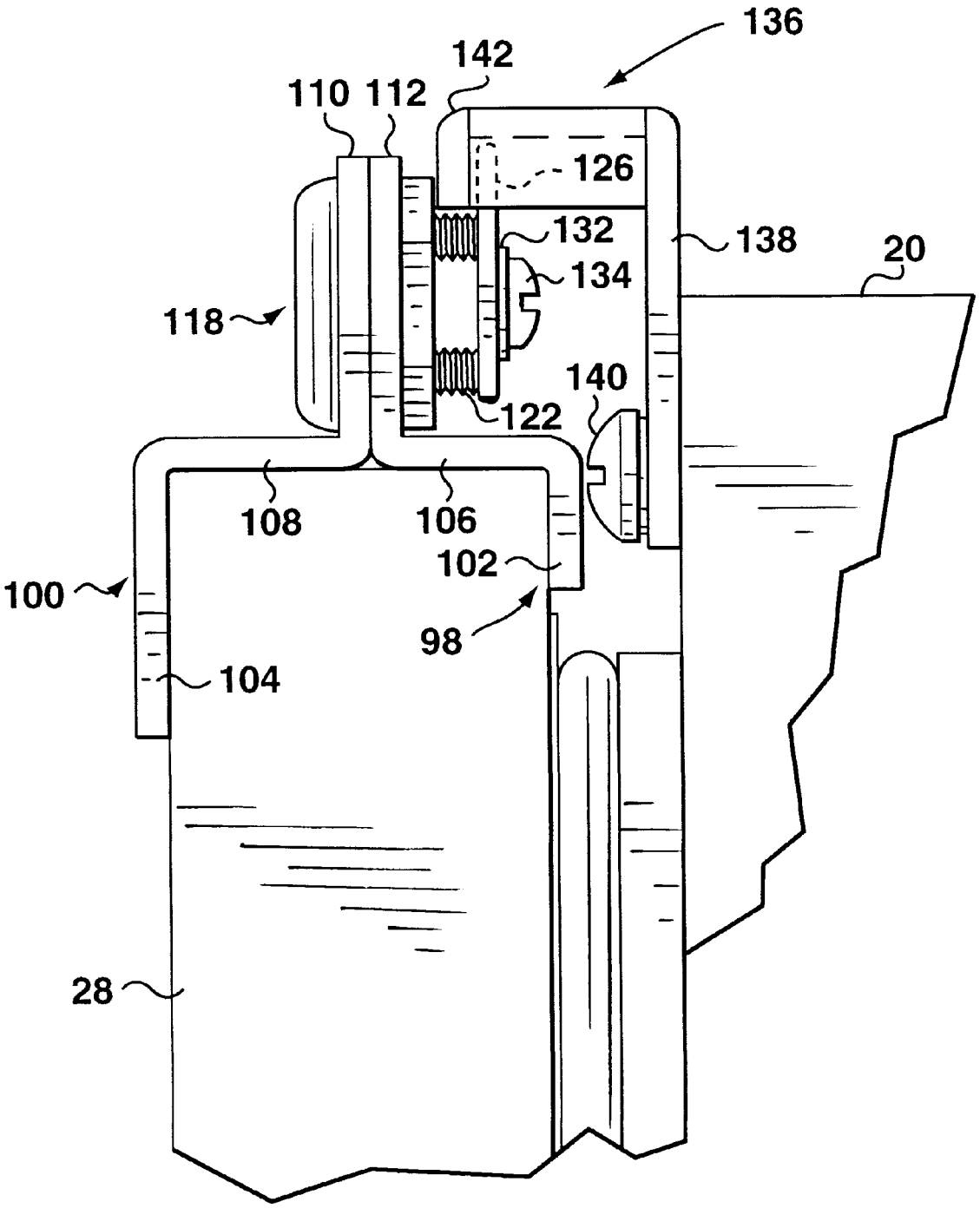
FIG. 7 is a similar view to FIG. 3 showing the second alternative embodiment of FIG. 6.

In a second alternative embodiment of the invention drawn in FIGS. 6 and 7, the door bracket is identified by reference numeral 96 and comprises inner and cuter door plates 98, 100, each having a respective first vertical portion 102, 104 adapted to lie against the inner and outer surfaces of a door 28, oppositely directed horizontal portions 106, 108 adapted to lie on the top free edge of the door 28, and respective second vertical portions 110, 112 extending upwardly above the associated door, the second vertical portions having respective openings 114, 116 formed therein to receive a cam lock assembly 118.

The cam lock assembly 118 has a key-operated locking shaft 120 having a squared end and rotatable inside a housing 122 having flat sides on opposite sides thereof for location in the openings 114, 116 which likewise have flat sides. The remainder of the housing 122 is threaded for cooperation with a threaded washer 124 whereby the cam lock assembly 118 is secured to the door bracket 96.

A locking member in the form of a pawl 126 pivoted to the locking shaft 120 is adapted to pivot with angular movement of the locking shaft 120 actuated by a key (not shown) and received in key slot 128. The pawl 126 has a square opening 130 to fit on the squared end of the locking shaft 120 and is secured in position by a washer 132 and a bolt 134 received in a threaded opening (not shown) formed in the end of the locking shaft 120.

A strike plate generally indicated by numeral 136, in FIG. 7, has a mounting plate 138 attached to a cabinet 20 by fasteners 140 and a locking plate 142 is spaced from the mounting plate 138 to receive the pawl 126 therebetween. It will be understood that the pawl 126 may be pivoted to a horizontal orientation where the cam lock assembly 118 is in a release position and it may be pivoted to a vertical orientation, as drawn, where the pawl 126 locates against the locking plate 142 to lock the swing door 28 to the cabinet 20.

In this embodiment, the locking plate is not apertured to receive the locking member, unlike the embodiment of FIGS. 1 to 4. Several other variations may be made to the embodiments described above, within the scope of the appended claims.

It will be appreciated that many cabinets are constructed so that the upper wall 22 does project upwardly above the maximum height of the associated door 28, as drawn in the accompanying figures. Conveniently, the lock assembly of the invention will occupy the space between the upper free edge of the door and the cabinet and only protrude a small height above the cabinet. However, it will be appreciated that the lock assembly may also be modified so that it will be suitable for cabinets in which the door is mounted so that its free edge is of commensurate height as the cabinet upper wall and, alternatively, could be adapted for mounting to the side wall of the cabinet as the case may be. Other variations may be made to the invention, as will be apparent to those skilled in the art.

We claim:

1. A lock assembly for a swing door hinged to a cabinet, the lock assembly comprising:

a strike plate having a mounting plate adapted to be mounted to the cabinet, and a locking plate forwardly spaced from the mounting plate by a transversely extending connecting web portion, the mounting plate and the locking plate being substantially parallel to each other;

a door bracket having an outer door plate adapted to locate on an outer surface of the swing door and inner door plate adapted to locate on an inner surface of the swing door, and coupling means joining said outer door plate and inner door plate so that a free edge of the swing door may be received therebetween;

and a locking member mounted to the door bracket, the locking member having a key-operated locking shaft coupled to the locking member for rotation therewith, the locking member being adapted to be disposed between the mounting plate and locking plate of the strike plate, and to locate against the locking plate to lock the swing door to the cabinet in a first angular position of the locking shaft, and the locking member being adapted to be released from the locking plate to unlock the swing door in a second angular position of the locking shaft.

2. A lock assembly for a swing door hinged to a cabinet, the lock assembly comprising;

a strike plate adapted to be mounted to the cabinet, the strike plate having a mounting plate apertured to receive at least one fastener to secure the strike plate to the cabinet and a locking plate forwardly spaced from the mounting plate by a transversely extending connecting web portion, the mounting plate and the locking plate being substantially parallel to each other, and the locking plate having an opening for receiving a locking member;

a door bracket having an outer door plate adapted to locate on an outer surface of the swing door, a transverse portion adapted to locate against a free edge of the swing door, a lock receiving portion extending outwardly from said free edge of the swing door, the transverse portion coupling said lock receiving portion to said outer door plate, an inner door plate adapted to locate on an inner surface of the swing door, and coupling means joining said outer door plate and inner door plate so that said free edge of the swing door may be received therebetween;

and a barrel lock mounted to the door bracket so as to be received by said lock receiving portion outside the swing door, the barrel lock comprising a key-operated barrel plunger rotatably received in a barrel housing and having a locking shaft coupled to the plunger for rotation therewith, the locking shaft having a locking member adapted to locate against the locking plate to lock the swing door to the cabinet in a first angular position of the locking shaft, the locking member being dimensioned to be received through said opening in the locking plate in a second angular position of the locking shaft so as to be released from the locking plate to unlock the swing door.

3. A lock assembly for a swing door hinged to a cabinet, the lock assembly comprising:

a strike plate having a mounting plate adapted to be mounted to the cabinet, and a locking plate spaced from the mounting plate;

a door bracket having an outer door plate adapted to locate on an outer surface of the swing door, a transverse portion adapted to locate against a free edge of the swing door, and a lock receiving portion extending outwardly from said free edge of the swing door, the transverse portion coupling said lock receiving portion to said outer door plate, and a locking member mounted to the door bracket so as to be received by said lock receiving portion outside the swing door, the locking member having a key-operated locking shaft coupled to the locking member for rotation therewith, the locking member being adapted to be disposed between the mounting plate and locking plate of the strike plate, and to locate against the locking plate to lock the swing door to the cabinet in a first angular position of the locking shaft, and the locking member being adapted to be released from the locking plate to unlock the swing door in a second angular position of the locking shaft.

4. A lock assembly for a swing door hinged to a cabinet, the lock assembly comprising;

a strike plate having a mounting plate adapted to be mounted to the cabinet, and a locking plate forwardly spaced from the mounting plate by a transversely extending connecting web portion, the mounting plate and the locking plate being substantially parallel to each other;

a door bracket having an outer door plate adapted to locate on an outer surface of the swing door, a transverse portion adapted to locate against a free edge of the swing door, and a lock receiving portion extending outwardly from said free edge of the swing door, the transverse portion coupling said lock receiving portion to said outer door plate, and a locking member mounted to the door bracket, so as to be received by said lock receiving portion outside the swing door, the locking member having a key-operated locking shaft coupled to the locking member for rotation therewith, the locking member being adapted to be disposed between the mounting plate and locking plate of the strike plate, and to locate against the locking plate to lock the swing door to the cabinet in a first angular position of the locking shaft, and the locking member being adapted to be released from the locking plate to unlock the swing door in a second angular position of the locking shaft.

* * * * *